US008584586B1

(12) United States Patent
Pugsley et al.

(10) Patent No.: US 8,584,586 B1
(45) Date of Patent: Nov. 19, 2013

(54) ROLL FREQUENCY DEPENDENCY CORRECTION TO CONTROL MAGNETIC SHIP SIGNATURES

(75) Inventors: Donald E. Pugsley, Silver Spring, MD (US); John J. Holmes, Columbia, MD (US); Robert W. Schuler, Derwood, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 338 days.

(21) Appl. No.: 13/100,059

(22) Filed: May 3, 2011

(51) Int. Cl.
*B63G 9/06* (2006.01)

(52) U.S. Cl.
USPC ..... 102/402; 89/1.13; 114/240 R; 701/525; 702/104

(58) Field of Classification Search
USPC ..... 102/402; 89/1.13; 114/240 R
See application file for complete search history.

(56) References Cited

U.S. PATENT DOCUMENTS

| | | | | | |
|---|---|---|---|---|---|
| 2,718,205 | A | * | 9/1955 | Gebs et al. | 114/240 R |
| 2,832,041 | A | * | 4/1958 | Trachtenberg | 114/240 R |
| 2,853,040 | A | * | 9/1958 | Grillo | 114/240 R |
| 2,891,502 | A | * | 6/1959 | Cochran, Jr. et al. | 114/240 R |
| 3,110,282 | A | * | 11/1963 | Foerster | 114/240 R |
| 3,215,904 | A | * | 11/1965 | Burt | 361/149 |
| 4,373,174 | A | * | 2/1983 | Akesson | 361/149 |
| 4,676,168 | A | * | 6/1987 | Cotton | 102/402 |
| 5,182,514 | A | * | 1/1993 | Rice, Jr. | 324/244 |
| 5,189,590 | A | | 2/1993 | Schneider | |
| 5,463,523 | A | * | 10/1995 | Holmes et al. | 361/149 |
| 5,483,410 | A | * | 1/1996 | Holmes et al. | 361/149 |
| 5,990,679 | A | * | 11/1999 | Frommer et al. | 324/244 |
| 6,008,641 | A | * | 12/1999 | Penfold et al. | 324/245 |
| 6,417,665 | B1 | * | 7/2002 | Scarzello et al. | 324/253 |
| 6,546,344 | B1 | * | 4/2003 | Rodrian et al. | 702/65 |
| 6,546,349 | B1 | * | 4/2003 | Tarr et al. | 702/107 |
| 6,798,632 | B1 | * | 9/2004 | Holmes et al. | 361/143 |
| 6,965,505 | B1 | * | 11/2005 | Mack et al. | 361/149 |
| 7,113,384 | B2 | * | 9/2006 | Swinbanks et al. | 361/143 |
| 7,451,719 | B1 | | 11/2008 | Fitzpatrick et al. | |
| 8,113,072 | B1 | * | 2/2012 | Smith, Jr. | 73/866.4 |
| 8,392,142 | B1 | * | 3/2013 | Conner et al. | 702/104 |

OTHER PUBLICATIONS

John J. Holmes, "Modeling a Ship's Ferromagnetic Signatures," Morgan & Claypool Publishers series, Synthesis Lectures on Computational Electromagnetic #16, 2007 (83 pages).

Benjamin Armstrong et al., "Field Measurement of Surface Ship Magnetic Signature Using Multiple AUVs," Oceans 2009, Marine Technology Society (MTS) / IEEE, Marine Technology for Our Future: Global and Local Challenges, Biloxi, MS, Oct. 26-29, 2009 (9 pages).

* cited by examiner

*Primary Examiner* — Bret Hayes
*Assistant Examiner* — Derrick Morgan
(74) *Attorney, Agent, or Firm* — Howard Kaiser

(57) ABSTRACT

The present invention provides three different algorithms, namely, the "divide and conquer" algorithm, the "Hiddensee compensation" algorithm, and the "impulse response" algorithm. Any one of these three inventive algorithms may be made a part of an overall degaussing algorithm for a marine vessel. Each corrective algorithm, by itself, compensates for deviation of the vessel's induced signature from direct, linear proportionality to the ambient magnetic field. This deviation is associated with the dependency of a marine vessel's magnetic signature on the frequency at which the vessel rolls in the water. Practice of inventive compensation tends to be increasingly called for with increasing magnetic character of the vessel.

6 Claims, 4 Drawing Sheets

ROLL FREQUENCY DEPENDENCY CORRECTION TO CONTROL MAGNETIC SHIP SIGNATURES

BACKGROUND OF THE INVENTION

The present invention relates to magnetic signatures of marine vessels, more particularly to the control (e.g., limitation, reduction, or minimization) of magnetic signatures of ships through algorithmic logic that is computer-implemented in association with a shipboard degaussing system.

A marine vessel (e.g., a ship or submersible) produces a magnetic signature as the vessel moves in the Earth's magnetic field. The magnetic signatures characterizing the vessel may be detectable by enemy devices. For instance, a vessel's magnetic signature may render the ship susceptible to magnetic mines. Various methodologies have been implemented, especially in military contexts, to reduce this magnetic signature.

Many ships of the United States Navy include magnetic signature compensation systems, known as "degaussing systems," which reduce ship magnetic signatures during ship motion in the Earth's magnetic field. The "closed-loop degaussing" (CLDG) as typically practiced by the U.S. Navy uses magnetometers, degaussing coils, and a computer (which executes a CLDG algorithm) to measure onboard magnetic fields, and to estimate offboard magnetic fields. Basically, CLDG actively compensates for the induced (nonpermanent) and permanent magnetic signals of a ship.

Nonpermanent magnetic signatures of ships in motion in a uniform magnetic field may be quantified, using quadrature analysis in the ship frame of reference, to produce two orthogonal signature components, viz., the "ferromagnetic induced" component and the "eddy current" component. The ferromagnetic induced component is in phase with the ambient magnetic field. The eddy current component is in phase with the time rate-of-change of this ambient magnetic field.

Some naval vessels, notably minesweepers, are constructed practically entirely from nonmagnetic material. Such vessels include magnetic signature control apparatus that assumes that the ferromagnetic induced signature is directly and linearly proportional to the ambient magnetic field, and that further assumes that the eddy current signature is directly and linearly proportional to the time rate-of-change of the ambient field. Practically speaking, these assumptions have been found to be correct for nonmagnetically hulled vessels (e.g., minesweepers), but incorrect for vessels (e.g., larger ships) that are constructed with greater amounts of magnetic and conductive material. Accordingly, for vessels that are more extensively conductive, these assumptions are erroneous and lead to inadequate signature compensation.

The following United States patents, incorporated herein by reference, are pertinent to degaussing of marine vessels: Schneider, "Closed-Loop Multi-Sensor Control System and Method," U.S. Pat. No. 5,189,590, issued 23 Feb. 1993; Holmes et al., "Zero Field Degaussing System and Method," U.S. Pat. No. 5,463,523, issued 31 Oct. 1995; Holmes et al., "Advanced Degaussing Coil System," U.S. Pat. No. 5,483,410, issued 9 Jan. 1996; Mack et al., "Ship Degaussing System and Algorithm," U.S. Pat. No. 6,965,505 B1, issued 15 Nov. 2005; Fitzpatrick et al., "High Temperature Superconducting Degaussing System." U.S. Pat. No. 7,451,719 B1, issued 18 Nov. 2008.

The term "six degrees of freedom" is conventionally used to describe both translational motion and rotational motion of a body with respect to three perpendicular axes in three-dimensional space. In general, a seagoing ship is characterized by motion describable in terms of six degrees of freedom, viz., heave, surge, sway, roll, pitch, and yaw. The three kinds of translational ship motion are commonly referred to as heave (linear movement along a vertical axis), surge (linear movement along a horizontal fore-and-aft axis), and sway (linear movement along a horizontal port-and-starboard axis). The three kinds of rotational ship motion are commonly referred to as roll (rotational movement about a horizontal fore-and-aft axis), pitch (rotational movement about a horizontal port-and-starboard axis), and yaw (rotational movement about a vertical axis).

SUMMARY OF THE INVENTION

In view of the foregoing, it is an object of the present invention to provide, for incorporation in or introduction into the overall degaussing algorithm for a marine vessel, a corrective algorithmic ingredient that is compensatory with respect to deviation of the vessel's ferromagnetic induced signature from direct and linear proportionality to the ambient magnetic field, such deviation being associated with the magnetic and conductive content of the vessel.

The term "present invention" as used herein encompasses, and refers to any one of, three distinct inventive algorithms, viz., the "divide and conquer" algorithm, the "Hiddensee compensation" algorithm, and the "impulse response" algorithm. The present invention provides three different methodologies of roll-frequency-dependent correction for the degaussing compensation of the ship's ferromagnetic induced signature. By so correcting, the present invention improves the accuracy of the degaussing system, thereby reducing the residual magnetic signature of the marine vessel (e.g., ship) as it moves in the Earth's magnetic field.

The present invention is based in part on its recognition that a marine vessel's magnetic signature may be characterized by a "roll frequency dependency," that is, a dependency on the frequency at which the vessel "rolls" in the water. This dependency on roll frequency (synonymously referred to herein as "roll rate") tends to be increasingly negligible for lower-conductivity vessel constructions, and increasingly significant for higher-conductivity vessel constructions.

In accordance with typical practice of the present invention's "divide and conquer" algorithm, ambient magnetic field measurements are performed in real time onboard a marine vessel. A real-time roll frequency analysis is conducted of the measured ambient magnetic field. Calibration of the degaussing system is performed in a test facility at selected roll frequencies. In real time onboard the vessel, a calculated amount of electrical current is applied to the degaussing coils that incorporates the calibrations as proportioned in accordance with the real-time roll frequency analysis of the measured ambient magnetic field.

In accordance with typical practice of the present invention's "Hiddensee compensation" algorithm, two kinds of roll frequency data are determined in a test facility. The first kind of roll frequency data is calculation of the correction factor at selected roll frequencies. The second kind of roll frequency data is measurement of the induced signature at the selected roll frequencies. A mathematical fit is performed of the two kinds of roll frequency data to find a polynomial. In real time onboard a marine vessel, the ambient magnetic field is measured, and the correction factor is calculated. The calculated correction factor and the polynomial are utilized to apply a calculated amount of electrical current to the degaussing coils.

In accordance with typical practice of the present invention's "impulse response" algorithm, sensor measurements are taken of a two kinds of impulse responses. The first impulse response is the response of a marine vessel to an impulse of the ambient magnetic field, and is indicative of a first roll frequency dependency. The second impulse response is the response of the ship's degaussing coils to an impulse of electrical current applied to the degaussing coils, and is indicative of a second roll frequency dependency. Calculation is performed, for various roll frequencies, of the amount of electrical current to be applied to the degaussing coils that results in an offset, with respect to each other, of the first impulse response and the second impulse response. This offset of the first and second impulse responses is indicative of an offset, with respect to each other, of the first and second roll frequency dependencies. During navigation of the vessel the calculated amount of electrical current that results in the offset of the first and second impulse responses is applied to the degaussing coils.

The present inventors observed experimentally that there was a decrease in a non-minesweeper ship's ferromagnetic induced signature in accordance with an increase in the roll frequency. Conventional degaussing assumes direct linear proportionality to the ambient magnetic field, regardless of the magnetic character of the vessel. Otherwise expressed, conventional degaussing does not factor in roll frequency dependency, and hence does not compensate for roll frequency by decreasing applied degaussing current in accordance with increased roll frequency. Therefore, the ferromagnetic induced compensations produced by conventional degaussing of significantly magnetic vessels (i.e., most vessels other than minesweepers) are increasingly inaccurate in accordance with increased roll frequency.

In testing conducted by the U.S. Navy, the eddy current signature variation with roll frequency in small steel-hulled ships was found to be similar to that observed in minesweeper tests; in other words, the eddy current signature variation with roll frequency was negligible. However, the ferromagnetic induced signature of these ships decreased as the roll frequency was increased, producing inaccurate ferromagnetic induced compensation at the higher roll rates. The U.S. Navy's standard degaussing increasingly overcompensated for the induced signature as the roll frequency increased. This inaccuracy of the conventionally used degaussing algorithm was attributable to its erroneous assumption that induced signature is constant regardless of roll frequency.

Other objects, advantages, and features of the present invention will become apparent from the following detailed description of the present invention when considered in conjunction with the accompanying drawings.

BRIEF DESCRIPTION OF THE DRAWINGS

The present invention will now be described, by way of example, with reference to the accompanying drawings, wherein.

DESCRIPTION OF EXEMPLARY EMBODIMENTS OF THE INVENTION

Figure 1:
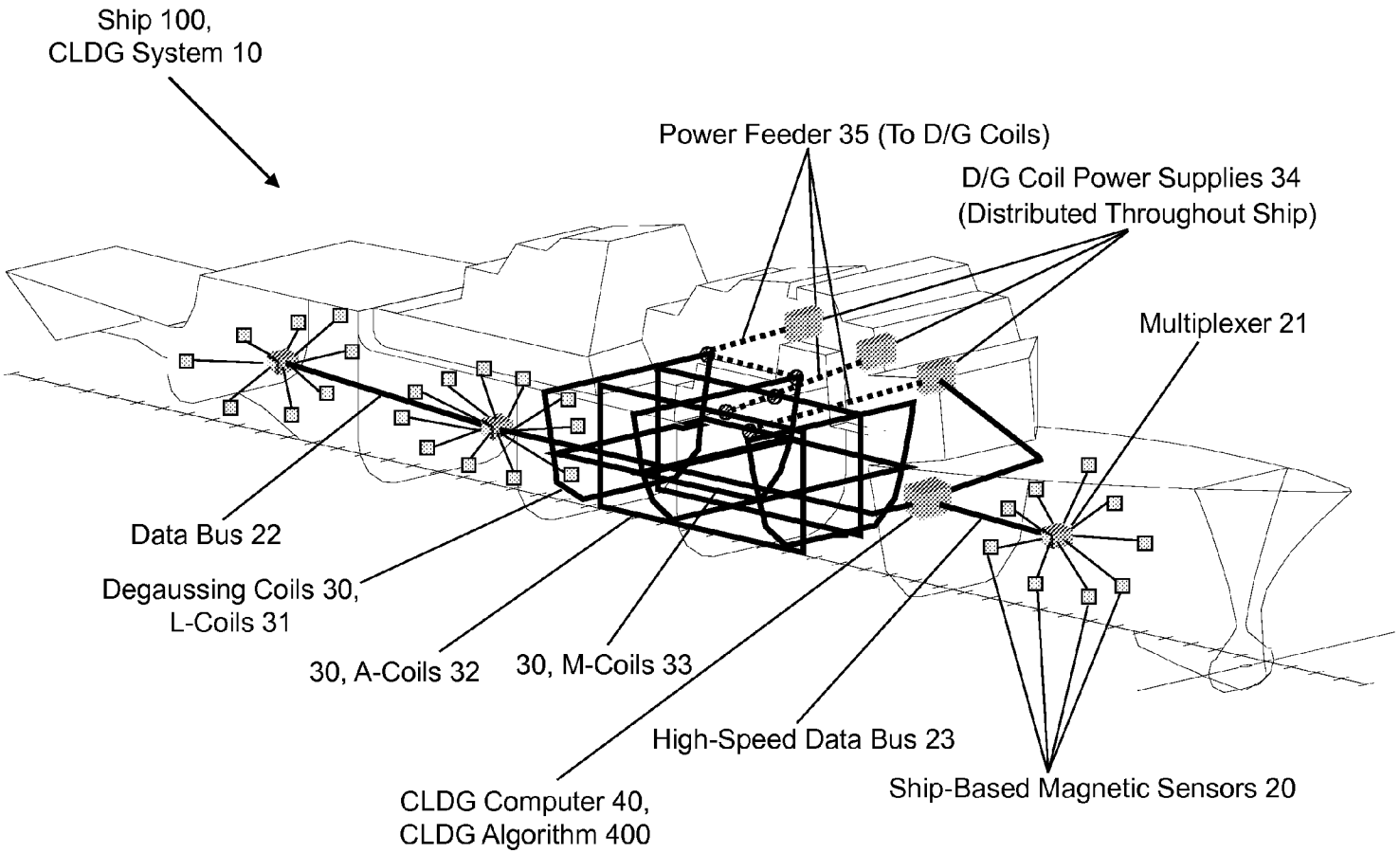
FIG. 1 is a diagrammatic perspective view of a representative ship and CLDG shipboard equipment installed on the ship.

Referring now to FIG. 1, a typical U.S. Navy ship 100 having a closed-loop degaussing (CLDG) system 10 installed thereon is equipped with ship-based magnetic sensors 20, multiplexers 21, a first data bus 22, a second (high-speed) data bus 23, degaussing coils 30, degaussing coil power supplies 34, power feeders 35 (to the degaussing coils 30), and a CLDG computer 40. Power supplies 34 are distributed throughout ship 200. Each multiplexer 21 is associated with a group of magnetic sensors 20. Degaussing coils 30 are configured as L-coils 31, A-coils 32, and M-coils 33.

The CLDG system 10 automatically monitors and maintains the ferromagnetic signature of ship 100 at a low level for all operational maneuvers and geographic locations. The CLDG computer 40 includes a processor (e.g., a processor-controller) and a memory. According to a typical CLDG system 100 such as implemented by the U.S. Navy, a CLDG control algorithm 400 is installed in the memory of, and is executed by the processor of, the CLDG computer 40. Shipboard degaussing equipment such as depicted in FIG. 1 is suitable for implementation of a degaussing (e.g., CLDG) algorithm in accordance with the present invention.

The traditional degaussing control algorithm 400 is devoid of consideration of roll frequency dependence. It is assumed by traditional algorithms that the induced signature of the ship is directly proportional to the ambient field at all roll rates, and that the eddy current signature is directly proportional to the time rate of change of the ambient field at all roll rates. These assumptions are acceptable for non-conductive hulled vessels such as minesweepers.

According to traditional degaussing, the local ambient field values X, Y, and Z (measured using a mast magnetometer, or calculated using a mathematical model), and calculated time rates of change of these ambient field values, are used to generate degaussing coil currents, using the following formula:

$$\begin{vmatrix} Coil1 \\ Coil2 \\ \dots \\ CoilN \end{vmatrix} = \begin{bmatrix} CX1 & CY1 & CZ1 & CX'1 & CY'1 & CZ'1 & CX''1 & CY''1 & CZ''1 \\ CX2 & CY2 & CZ2 & CX;2 & CY'2 & CZ'2 & CX''2 & CY''2 & CZ''2 \\ \dots & \dots & \dots & \dots & \dots & \dots & \dots & \dots & \dots \\ CXN & CYN & CZN & CX'N & CY'N & CZ'N & CX''N & CY''N & CZ''N \end{bmatrix} \begin{vmatrix} X \\ Y \\ Z \\ X' \\ Y' \\ Z' \\ X'' \\ Y'' \\ Z'' \end{vmatrix}$$

where the prime notation (for instance, as in "X'") is used to denote a derivative with respect to time.

This matrix multiplication requires, as input, the first and second derivatives of the ambient magnetic field in the ship's frame of reference. The ferromagnetic compensation coefficients are multiplied by the ambient field values to produce coil currents (and compensating magnetic fields) that are proportional to, and in phase with, the ambient field. The eddy current coefficients are multiplied by the first derivatives to produce the eddy current compensation currents, which are ninety degrees (90°) out of phase from the applied field. The second derivative terms are included so that secondary eddy currents, caused by the application of eddy current compensation, can be compensated as well.

"Divide and Conquer" Algorithm

Figure 2:
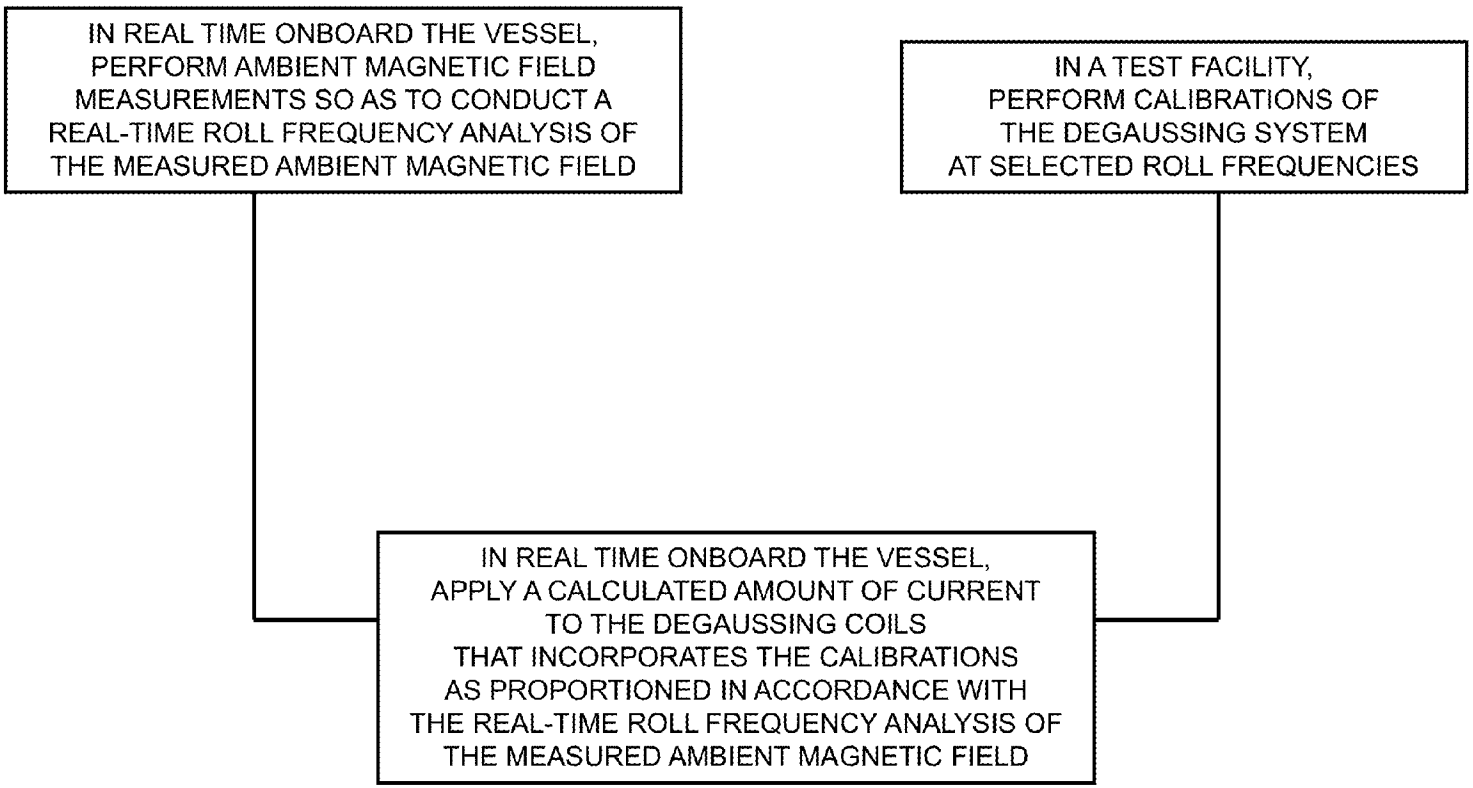
FIG. 2 is a flow diagram of an embodiment of a "divide and conquer" algorithm in accordance with the present invention.

With reference to FIG. 2, the present invention's "divide and conquer" algorithm utilizes "divide-and-conquer" analysis to control magnetic ship signatures. Essentially, the inventive divide-and-conquer methodology for signature compensation accounts for the roll frequency dependence of a vessel's ferromagnetic induced signature by performing, during seagoing, a real-time roll-frequency analysis of the measured ambient field measurement, and applying a summed compensation current calculated from calibrations previously performed at distinct predetermined roll frequencies at a test (e.g., magnetic silencing) facility.

The magnetometer signal produced when a ship rolls in the Earth's magnetic field has significant components at the roll frequency and the first few harmonics. If the degaussing system is calibrated separately at each of these roll frequencies, these calibrations can be combined, in the degaussing system's control algorithm, with proportions determined by a real-time frequency analysis of the ambient field.

To recapitulate, according to typical embodiments of the present invention's "divide and conquer" algorithm: ambient magnetic field measurements are performed; a real-time roll frequency analysis is conducted of the measured ambient magnetic field; calibration of the degaussing system is performed at selected roll frequencies; and, current is applied to the degaussing coils that incorporates the calibrations as proportioned in accordance with the real-time roll frequency analysis.

"Hiddensee Compensation" Algorithm

Figure 3:
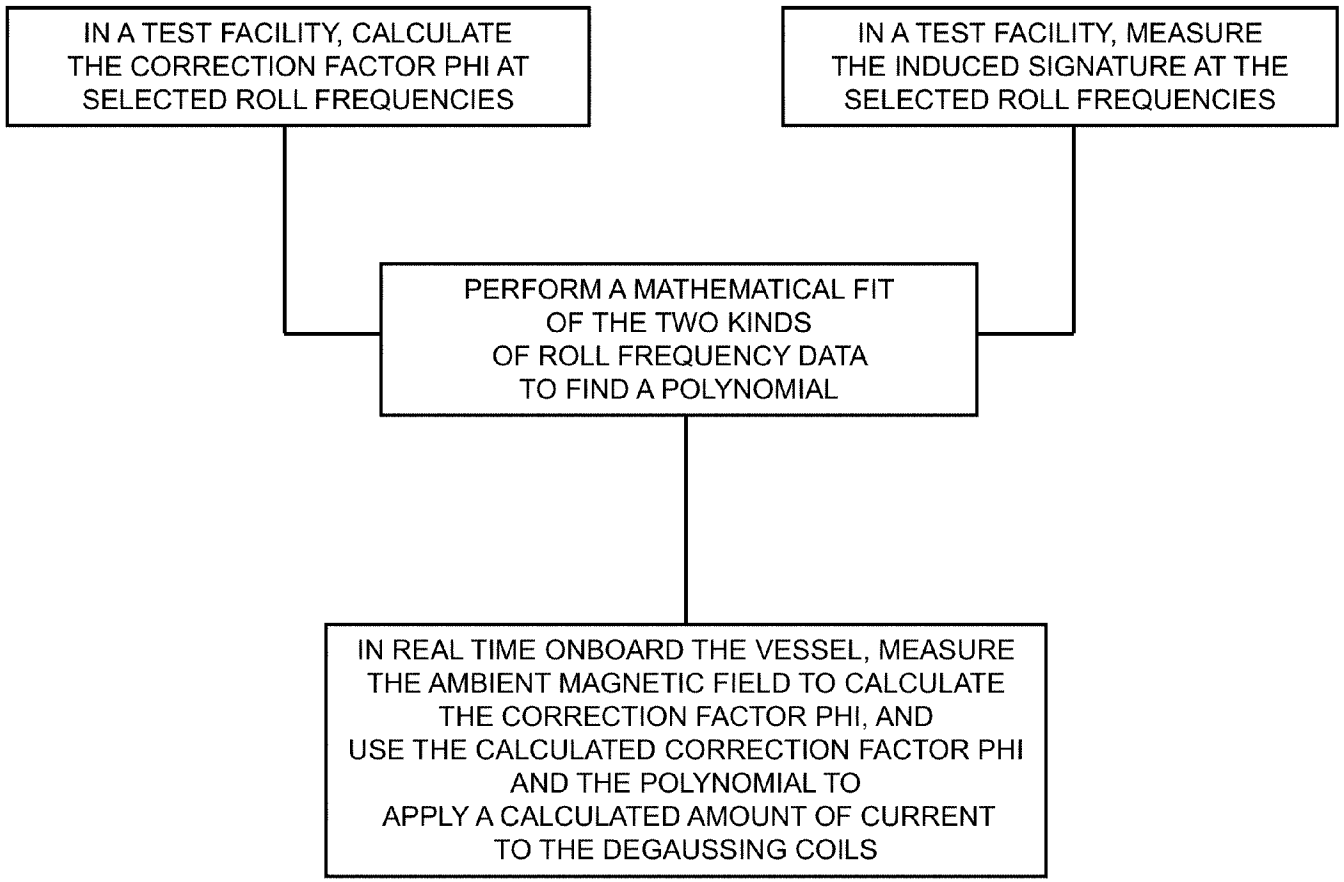
FIG. 3 is a flow diagram of an embodiment of a "Hiddensee compensation" algorithm in accordance with the present invention.

With reference to FIG. 3, the present invention's Hiddensee compensation algorithm utilizes "empirical frequency response analysis" to control magnetic ship signatures. Essentially, in order to correct for decrease in induced signature in accordance with increase in roll frequency, an empirical "roll-frequency parameter" calculation is added to the degaussing control software, and an empirical quadratic fit is performed to the observed data.

The result, once the Hiddensee compensation algorithm's empirical factors are entered into the software, is a roll-frequency-dependent reduction in the degaussing current requested by the degaussing algorithm for induced compensation. Some mathematical details of this, the present invention's "Hiddensee compensation" algorithm (the "Hiddensee" referring to a U.S. Navy ship used for inventive testing), are set forth hereinbelow.

The roll-frequency tracking parameter (synonymously referred to herein as the "phi" factor) was calculated as follows. If the inducing magnetic field is written as $$F_i(t)=A\sin(2\pi ft)$$

where f is the roll frequency, then the first derivative of the inducing magnetic field is $$\frac{d}{dt}F_i(t) = 2\pi fA\cos(2\pi ft).$$

Were it not for the sine and cosine terms, the quantity $$\frac{\frac{d}{dt}F_i(t)}{F_i(t)}$$

would be proportional to the roll frequency, f. Since the automatic degaussing control (ADC) software maintains a time history of the inducing magnetic field for derivative calculations, the peak-to-peak magnitude of the inducing field and the first derivative can be used in place of cos(2πft) and sin(2πft) in the above calculations. Accordingly, a frequency factor "phi," symbolized as "Φ," provides a useful roll frequency measurement, wherein phi is defined by $$\Phi = \frac{\text{peak-to-peak}\left(\frac{d}{dt}F_i(t)\right)}{\text{peak-to-peak}(F_i(t))}.$$

The Hiddensee compensation algorithm's correction factor phi is mathematically implemented as representative of the roll frequency. That is, at a test facility, the correction factor phi is calculated for selected measured roll frequencies of a vessel. Furthermore, at the test facility, the induced signature is measured at each measured roll frequency of the vessel. Using these two types of data, a mathematical relationship is determined whereby, in real time onboard the vessel, a measured ambient magnetic field is indicative of the phi factor correction to be made.

To elaborate, at a testing facility, the correction factor phi is calculated for a variety of roll frequencies. The magnitude is observed of the uncompensated ferromagnetic signature at each of those roll frequencies. The observed induced signature falloff is empirically determined for any roll frequency within the range of the test facility. A simple polynomial is fitted to the observed points, and the polynomial coefficients are entered into the degaussing control software calibration set.

Accordingly, the degaussing controller onboard a vessel: calculates the phi factor in real time using observed ambient field values; calculates the appropriate scaling factor using the known polynomial coefficients; and, scales the induced compensation currents by the resultant scaling factor value/number.

To summarize, according to typical embodiments of the present invention's "Hiddensee compensation" algorithm: a correction factor "phi" is empirically determined at selected roll frequencies; the induced signature is measured at the selected roll frequencies; both roll frequency data groups are fit to find a polynomial; and, current is applied to a navigating vessel's degaussing coils in accordance with the polynomial and a correction factor phi calculated for a measured ambient magnetic field.

"Impulse Response" Algorithm

Figure 4:
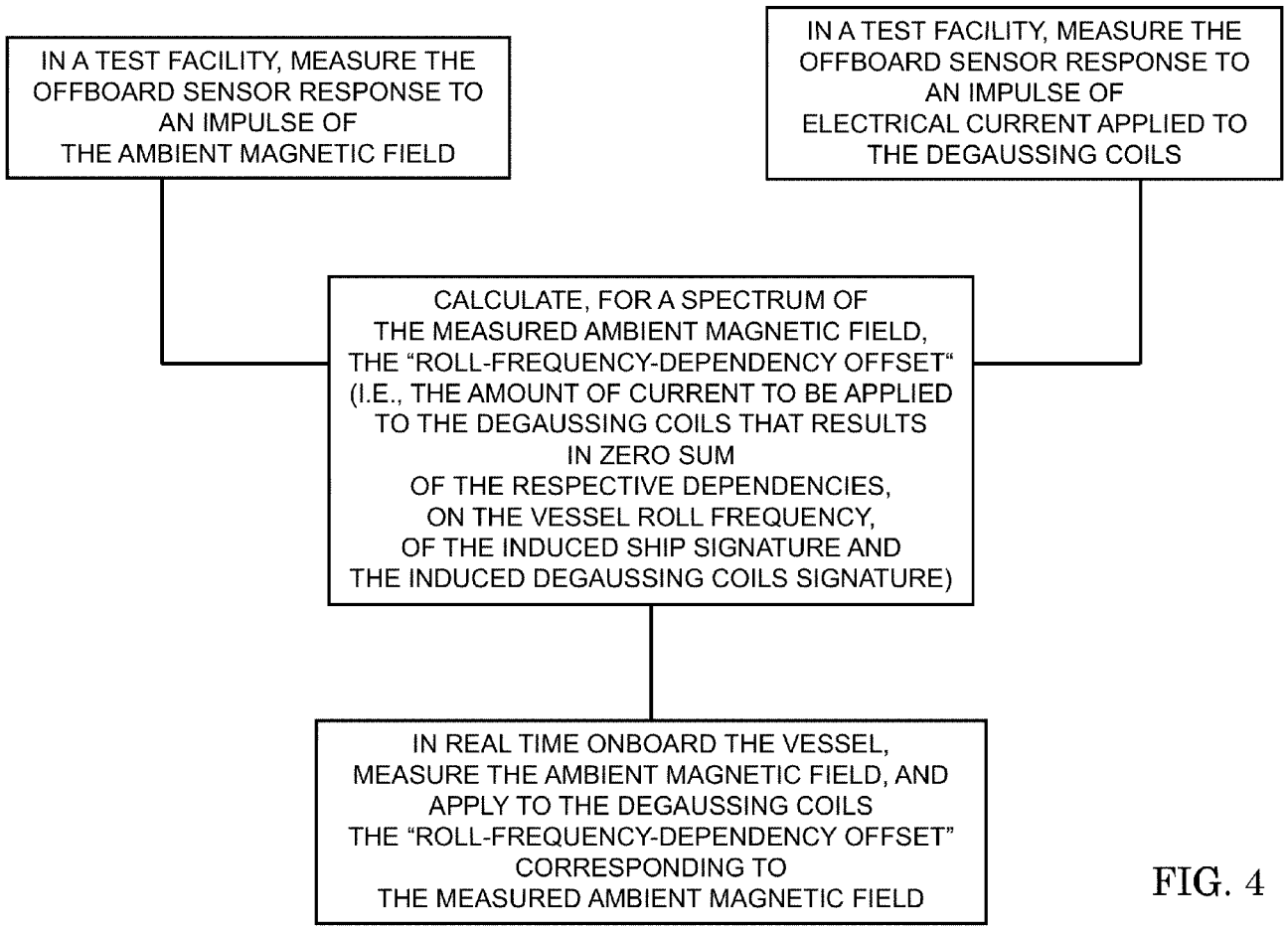
FIG. 4 is a flow diagram of an embodiment of an "impulse response" algorithm in accordance with the present invention.

Now referring to FIG. 4, the present invention's "impulse response" algorithm utilizes impulse response analysis to control magnetic ship signatures. The inventive impulse response algorithm solves the roll frequency dependence problem by combining the measured step responses of the ship and the degaussing coils, respectively, to produce optimal compensation based on a continuous roll frequency spectrum.

Generally speaking, the term "impulse response" is used in various technical contexts to describe a dynamic system's reaction to an external change as a function of time. Sometimes in signal processing, for instance, "impulse response" refers to a dynamic system's output that is responsive to an "impulse," i.e., a brief input signal. A unique premise of the inventive "impulse response" algorithm is that the impulse response of a system provides a direct measurement of that system's roll frequency response characteristics.

An ambient magnetic field impulse is created by an electromagnetic reduction (EMR) facility's coil system. The ship's uncompensated response to the ambient magnetic field impulse is measured. That is, offboard sensor readings are taken (e.g., using one or more magnetometers measuring strength and/or direction of the ship's induced magnetic field) to measure the ship's response to the ambient magnetic field impulse. This impulse response of the ship is considered as a time sequence of the discretely sampled offboard sensor (e.g., magnetometer) readings. By direct analysis of this measurement data of the impulse response of the ship, the ship's response to any ambient magnetic field change is mathematically determined. In other words, based on measurements of the offboard sensor response to an ambient magnetic field impulse, the offboard sensor signal caused by any ambient magnetic field change is computed.

Likewise, after measuring the offboard sensor response to a degaussing coil current impulse, the offboard sensor signal caused by any coil current change may be determined. A degaussing coil current impulse is created at the EMR facility. The degaussing coil's uncompensated response to a degaussing coil current impulse, also created at the EMR facility, is measured. That is, offboard sensor readings are taken (e.g., using one or more magnetometers measuring strength and/or direction of the of the degaussing coil's induced magnetic field) to measure the degaussing coils' response to the degaussing coil impulse. This impulse response of the ship's degaussing coils is considered as a time sequence of the discretely sampled offboard sensor readings. By direct analysis of this measurement data of the impulse response of the ship's degaussing coils, the response is mathematically determined of the ship's degaussing coils to any change in current conducted by the ship's degaussing coils.

The present invention's impulse response algorithm uses the two above-described groups of measurement data taken by offboard sensors (e.g., magnetometers), viz., (i) the ship's impulse response to an impulse of the ambient magnetic field, and (ii) the degaussing coils' impulse response to an impulse of electrical current conducted by the degaussing coils. The inventive impulse response algorithm applies a calculation to the combination of (i) the ship's response, as indicated by the measured induced magnetic field of the ship, to any ambient magnetic field change and (ii) the degaussing coils' response, as indicated by the measured induced magnetic field of the degaussing coils, to any degaussing coil current change.

More specifically, the inventive impulse response algorithm determines the magnitude of the degaussing coil currents to be applied that will cause the ship's impulse response and the degaussing coils' impulse response to cancel one another. According to typical inventive practice, this cancellation of ship's and degaussing coils' respective impulse responses is computed as a function of the ambient magnetic field. Accordingly, the inventive impulse response algorithm represents a roll-frequency-dependency neutralization calibration that is incorporated into the overall degaussing algorithm. By incorporating the inventive impulse response algorithm, the overall degaussing algorithm, in ongoing fashion, applies degaussing current to the degaussing coils that continually compensates for variation in roll frequency.

It is impractical to generate an infinite impulse in a real-world degaussing coil system. Therefore, in real-world calibration operations according to typical practice of the inventive impulse response algorithm, a step function is measured instead of an infinite function. The derivative of this step function data with respect to time converts the step response data into the desired impulse response.

An important premise of the inventive impulse response algorithm is that two different systems—viz., (i) the ship system, and (ii) the degaussing coils system—together constitute the aggregate system that is affected by the roll frequency of the vessel. The magnetic character of each of the two different systems is dependent upon the roll frequency; that is, the ship system magnetism and the degaussing coils system magnetism each change in accordance with change in the roll frequency of the ship. The measured response of the ship system to an ambient magnetic field impulse is indicative of the response of the ship system to variation in roll frequency of the ship. Similarly, the measured response of the degaussing coils to an electrical current impulse is indicative of the response of the degaussing coils to variation in roll frequency of the ship.

In order to take roll-frequency-dependency "out of the mix," so to speak, the present invention's impulse response algorithm provides a correction, for practically any measured ambient magnetic field strength, to the overall degaussing current applied to the degaussing coils. Typically in real time, the inventive impulse response algorithmic correction counteracts (offsets or zero-sums) the total of the respective systemic variations (i.e., of the ship system and the degaussing coils system) to variation in roll frequency. In this manner, the overall degaussing algorithm current that is sent to the degaussing coils is more accurately reflective of the actual induced signature of the vessel.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications, and changes to the principles disclosed herein may be made by one skilled in the art without departing from the true scope and spirit of the present invention, which is indicated by the following claims.

What is claimed is:

1. A method implemented using a computer for degaussing a marine vessel having degaussing coils associated therewith, the method comprising:

in a test facility, measuring a first impulse response, said first impulse response being the offboard sensor response of the vessel to an impulse of the ambient magnetic field, said first impulse response being indicative of a first roll frequency dependency, said first roll frequency dependency being the dependency, on the roll frequency of the vessel, of the induced signature of the vessel;

in a test facility, measuring a second impulse response, said second impulse response being the offboard sensor response of the degaussing coils to an impulse of electrical current applied to the degaussing coils, said second impulse response being indicative of a second roll frequency dependency, said second roll frequency dependency being the dependency, on the roll frequency of the vessel, of the induced signature of the degaussing coils;

calculating, for a spectrum of the ambient magnetic field, a roll-frequency-dependency offset, said roll-frequency dependency offset being the amount of electrical current to be applied to the degaussing coils that results in zero sum of said first roll frequency dependency and said second roll frequency dependency;

in real time onboard the vessel, measuring the ambient magnetic field; and in real time onboard the vessel, applying to the degaussing coils said roll-frequency-dependency offset corresponding to the ambient magnetic field measured in real time onboard the vessel.

2. The method for degaussing of claim 1, wherein:

said measuring of said first impulse response and said measuring of said second impulse response are performed during non-navigation of said vessel;

said measuring of the ambient magnetic field in real time and said applying of the roll-frequency-dependency offset in real time are performed during navigation of said vessel.

3. A computer program product comprising a computer readable storage medium having a computer readable program stored thereon for execution by a computer to perform a method for controlling the amount of current conducted by degaussing coils installed onboard a marine vessel, the method including:

accessing a first data group, said first data group including sensor measurements of a first impulse response, said first impulse response being the offboard sensor response of the vessel to an impulse of the ambient magnetic field, said first impulse response being indicative of a first roll frequency dependency, said first roll frequency dependency being the dependency, on the roll frequency of the vessel, of the induced signature of the vessel;

accessing a second data group, said second data group including sensor measurements of a second impulse response, said second impulse response being the offboard sensor response of the degaussing coils to an impulse of electrical current applied to the degaussing coils, said second impulse response being indicative of a second roll frequency dependency, said second roll frequency dependency being the dependency, on the roll frequency of the vessel, of the induced signature of the degaussing coils;

calculating, for a spectrum of the ambient magnetic field, a roll-frequency-dependency offset, said roll-frequency dependency offset being the amount of electrical current to be applied to the degaussing coils that results in zero sum of said first roll frequency dependency and said second roll frequency dependency;

in real time onboard the vessel: measuring the ambient magnetic field; and applying to the degaussing coils said roll-frequency-dependency offset corresponding to the ambient magnetic field measured in real time onboard the vessel.

4. The computer program product of claim 3, wherein:

said sensor measurements of said first impulse response and said sensor measurements of said second impulse response are performed during non-navigation of said vessel;

said measuring of the ambient magnetic field in real time and said applying of the roll-frequency-dependency offset in real time are performed during navigation of said vessel.

5. A marine vessel degaussing system comprising plural degaussing coils installed onboard said vessel and a computer connected to said degaussing coils, said computer being configured to execute computer program logic that, when executed, is capable of causing electrical current to be conducted by said degaussing coils that takes into account variation of the induced magnetic signature of said vessel in accordance with variation of the roll frequency of said vessel, wherein according to the computer program logic:

a first data group includes sensor measurements of a first impulse response, said first impulse response being the offboard sensor response of the vessel to an impulse of the ambient magnetic field, said first impulse response being indicative of a first roll frequency dependency, said first roll frequency dependency being the dependency, on the roll frequency of the vessel, of the induced signature of the vessel;

a second data group includes sensor measurements of a second impulse response, said second impulse response being the offboard sensor response of the degaussing coils to an impulse of electrical current applied to the degaussing coils, said second impulse response being indicative of a second roll frequency dependency, said second roll frequency dependency being the dependency, on the roll frequency of the vessel, of the induced signature of the degaussing coils;

a roll-frequency-dependency offset is calculated for a spectrum of the ambient magnetic field, said roll-frequency dependency offset being the amount of electrical current to be applied to the degaussing coils that results in zero sum of said first roll frequency dependency and said second roll frequency dependency;

actions including the following are performed in real time onboard the vessel:

measurement of the ambient magnetic field; and application, to the degaussing coils, of said roll-frequency-dependency offset corresponding to the ambient magnetic field measured in real time onboard the vessel.

6. The marine vessel degaussing system of claim 5, wherein:

said sensor measurements of said first impulse response are taken during non-navigation of said vessel;

said sensor measurements of said second impulse response are taken during non-navigation of said vessel;

said measurement of the ambient magnetic field and said application of said roll-frequency-dependency offset are performed in real time during navigation of said vessel.

* * * * *